US006280915B1

(12) United States Patent
Van den Zegel et al.

(10) Patent No.: US 6,280,915 B1
(45) Date of Patent: Aug. 28, 2001

(54) SPECTRALLY SENSITIZED TABULAR GRAIN PHOTOGRAPHIC MATERIALS

(75) Inventors: Marc Van den Zegel, Boortmeerbeek; Jan Claes, Mortsel; Jean-Marie Dewanckele, Drongen, all of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 08/267,527

(22) Filed: Jun. 29, 1994

(30) Foreign Application Priority Data

Jul. 12, 1993 (EP) ..... 93202049

(51) Int. Cl.[7] ..... G03C 1/46

(52) U.S. Cl. ..... 430/502; 430/567; 430/599; 430/609; 430/637; 430/966

(58) Field of Search ..... 430/502, 567, 430/599, 609, 637, 966

(56) References Cited

U.S. PATENT DOCUMENTS 4,013,471 * 3/1977 Pollet et al. ..... 430/599
5,196,299 * 3/1993 Dickerson et al. ..... 430/966

* cited by examiner

*Primary Examiner*—Geraldine Letscher

(74) *Attorney, Agent, or Firm*—Breiner & Breiner, L.L.C.

(57) ABSTRACT

A silver halide coated photographic material is disclosed comprising sensitized silver bromide or silver bromoiodide tabular grains having an average thickness of less than 0.30 μm, in at least one light-sensitive layer and which is characterised in that it further contains in the said light-sensitive layer and/or at least one non-light sensitive layer at least one polyoxyethylene compound comprising from about 20 to 100 mole percent recurring units of the formula (Ia)

(Ia)

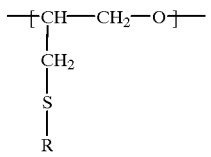

and 80 to 0 mole % recurring units of the formula (Ib)

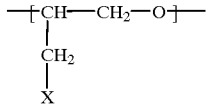

and wherein R represents an aliphatic, aromatic, or heterocyclic group, and X represents a halogen.

7 Claims, No Drawings

SPECTRALLY SENSITIZED TABULAR GRAIN PHOTOGRAPHIC MATERIALS

FIELD OF THE INVENTION

This invention relates to tabular grain emulsions suitable for use in radiographic elements exhibiting reduced dye stain.

BACKGROUND OF THE INVENTION

Tabular grain emulsions have found a wide acceptance in the art of photography.

Tabular grains are herein defined as grains having two substantially parallel (111) crystal faces, each of which is substantially larger than any other single crystal face of the grain. The aspect ratio, that is the ratio of the diameter to thickness of the tabular grains is substantially greater than two.

In a radiographic element, spectrally sensitized tabular grain emulsions as compared to non-tabular grain emulsions having a comparable speed (sensitivity) and silver coverage, show an improved granularity, an increased silver image covering power especially for strongly hardened layers, a more rapid developability and a decreased dependence of the photographic results on changes of the processing temperature.

Besides these general advantages tabular grain emulsions, coated in double side coated radiographic materials, show an improved speed-cross-over relationship as set forth in U.S. Pat. No. 4,411,986.

Although double side coated radiographic elements containing spectrally sensitized tabular grains have numerous advantages an important disadvantage is met for tabular grains having a mean grain thickness of less than 0.3 $\mu$m in that an increased dye stain of the fully processed radiographic elements can occur. This dye stain is the result of an incomplete removement of the spectral sensitizer during processing. Because of their high surface to volume ratio tabular grains contain significantly higher amounts of spectral sensitizer per volume of silver halide to obtain the optimal sensitivity and thus higher amounts of spectral sensitizer have to be removed.

Particularly with relation to recent trends as shorter processing times to save time, lower regeneration volumes with a composition that is less threatening the environment, it is important to offer suitable films to the customer that are adapted to the new requirements.

Solutions for the increased dye stain after processing have been described e.g. in EP-Application 426 193 and U.S. Pat. No. 4,960,683, wherein thiols, triazolium thiolates, disulphides and thioether compounds have been added to the processing solutions or to the photographic material. The addition of products to the layer(s) of the photographic material that are released during the processing of the said material are described in U.S. Pat. No. 5,108,888.

Another solution is offered by the choice of a spectral sensitizing dye with an adapted structure like benzimidazolo carbocyanines disclosed in EP-A 506 584. Other miscellaneous measures consist e.g. in the addition of very fine high silver iodide crystals to the protective coating capable of being dissolved during fixation as in U.S. Pat. No. 4,520,098.

OBJECT OF THE INVENTION

It is an object of the present invention to provide reduced dye stain in a radiographic material with spectrally sensitized tabular grain emulsions after processing said materials in a rapid processing cycle of less than 60 seconds dry to dry and/or under processing conditions using lower regeneration volumes.

It is a further object of the present invention to provide a material that should be particularly suitable for the said rapid processing cycle with an acceptable dye stain.

Further objects will become apparent from the description hereinafter.

SUMMARY OF THE INVENTION

According to this invention a silver halide coated X-ray photographic material is disclosed comprising exposed spectrally sensitized silver bromide or silver bromoiodide tabular grains having an average thickness of less than 0.30 $\mu$m, in at least one light-sensitive layer and which is characterised in that it further contains in the said light-sensitive layer and/or at least one non-light sensitive layer at least one polyoxyethylene compound comprising from about 20 to 100 mole percent recurring units of the formula (Ia)

(Ia)

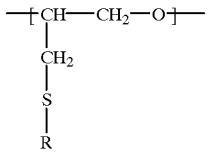

and 80 to 0 mole % recurring units of the formula (Ib)

(Ib)

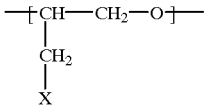

and wherein R represents an aliphatic, aromatic, or heterocyclic group, and X represents a halogen e.g. bromine or chlorine.

DETAILED DESCRIPTION OF THE INVENTION

According to this invention R is preferably selected from the group consisting of alkyl, aralkyl, hydroxyalkyl, alkoxyalkyl, alkylthioalkyl, acyloxyalkyl, cycloalkyl and aryl. Still more preferably R is a alkyl and the number of carbon atoms is from 1 to 5.

Polyethylene oxide compounds carrying thioether groups as substituents on the linear chain are known for accelerating or activating the development of exposed silver halide elements as set forth in U.S. Pat. No. 4,013,471. Said activators can be used in silver complex diffusion transfer processes wherein the alkaline processing solution contains a tertiary alkanolamine and that is free of primary and secondary alkanolamines as has been described in EP-Application 565 152, filed Apr. 10, 1992. Unexpectedly, a long term ambient storage and/or usage of the alkaline solution without loss of overall process quality becomes achievable by applying that invention.

Specific examples of compounds for use according to this invention are given hereinafter (see compounds I.1 to I.3):

(I.1)

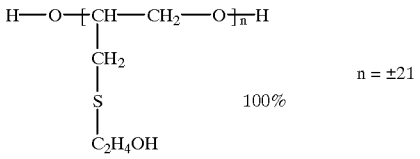

n = ±21

100%

(I.2)

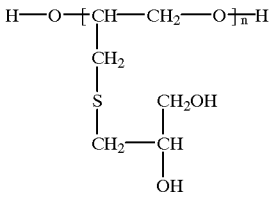

(I.3)

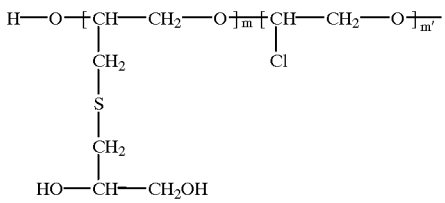

m + m′ = ±21
m/m′ = ±4/1

In a preferred embodiment 60 to 0 mole % recurring units of the formula (Ib)

(Ib)

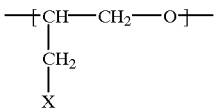

and still more preferably only 40 to 0 mole % of the said recurring units are present, whereas preferably from about 40 to 100 mole percent and still more preferably 60 to 100 mole percent recurring units of the formula (Ia)

(Ia)

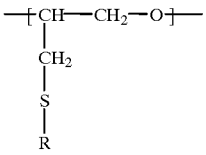

are present.

According to the present invention the tabular silver bromide or silver bromoiodide grains can be prepared as described by Berry et al in Photographic Science and Engineering, Vol 5, No 6, 1961, by Duffin, Photographic Emulsion Chemistry, Focal Press, 1966, p. 66–72 and by early patent literature including Bogg U.S. Pat. No. 4,063,951, Lewis U.S. Pat. No. 4,067,739 and Maternaghan U.S. Pat. Nos. 4,150,994; 4,184,877 and 4,184,878. However as the tabular grains described therein cannot be regarded as showing a high diameter to thickness ratio, commonly termed aspect ratio, it is more preferable to prepare the silver bromide or silver bromoiodide used in this invention as described in U.S. Pat. No. 4,434,226 (Wilgus et al.) for tabular silver bromoiodide grains having a thickness less than 0.2 μm, a diameter of at least 0.6 μm and an average aspect ratio greater than 8:1 and accounting for at least 50 percent of the total projected area of all the emulsion grains; U.S. Pat. No. 4,439,520 (Kofron et al) for similar grains which are spectrally sensitized; U.S. Pat. No. 4,425,425 (Abbott et al) for radiographic materials containing tabular grains with an aspect ratio of at least 8:1 and U.S. Pat. No. 4,425,426 from the same author for similar grains with an aspect ratio between 5:1 and 8:1 as well as the survey on high aspect ratio silver halide emulsions as appeared in Research Disclosure, Volume 225, January 1983, Item 22534. A way can be followed to prepare tabular grains with an increased thickness as described in U.S. Pat. Nos. 4,801,522; 5,028,521 and 5,013,641 making use of ammonia or ammonia generated "in situ".

In accordance with the present invention a more preferred method for the preparation of an emulsion with tabular silver halide grains, having an average thickness of less than 0.30 μm and an average aspect ratio of at least 2:1 has been described in EP-Application No. 92.201.259.

For silver bromoiodide crystals it is specifically contemplated to incorporate up to 3 mole percent of iodide ions in the silver halide e.g. silver bromide tabular grains of the present invention. This can be achieved by mixing a soluble bromide and a soluble iodide salt in one or more of the halide solutions up to the desired mole % concentrations required in each preparation step or by a triple jet technique, or separate addition of a iodide containing aqueous solution. Due to the lower solubility of iodide ions in comparison with bromide ions, said iodide ions are able to displace bromide ions from the grain, a technique known in the art as conversion. Iodide ions may also be incorporated into the silver halide crystal lattice by the addition of a previously prepared silver iodide micrate emulsion, composed of either pure silver iodide or mixed halides.

Two or more types of tabular silver halide emulsions that have been prepared differently can be mixed for forming a photographic emulsion for use in accordance with the present invention.

The size distribution of the tabular silver halide particles of the photographic emulsions to be used according to the present invention becomes more heterodisperse by the addition of more silver nitrate during the first growth step at a pBr value lower than 1.7, said value being preferably lower than 1.2. In this way low contrast heterodisperse emulsions with a coefficient of variation of the tabular grains between 0.20–0.45 and even between 0.30–0.45 can be obtained. According to this invention however an enhanced contrast is obtained if the polyoxyethylene compounds mentioned hereinbefore are used.

The tabular silver halide emulsions in connection with the present invention can be chemically sensitized as described e.g. in "Chimie et Physique Photographic" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, sulphites, mercapto compounds, and rhodamines. The emulsions may be sensitized also by means of gold-sulphur ripeners or by means of reductors e.g. tin compounds as described in GB-P 789,823, amines, hydrazine derivatives, formamidine-sulphinic acids, and silane compounds.

The tabular silver halide emulsions may be spectrally sensitized with methine dyes such as those described by F.

M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. A survey of useful chemical classes of spectral sensitizing dyes and specific useful examples in connection with tabular grains is given in the already cited Research Disclosure Item 22534. Especially preferred green sensitizer in connection with the present invention are anhydro-5,5'-dichloro-3,3'-bis(n.sulfobutyl)-9-ethyloxacarbo-cyanine hydroxide and anhydro-5,5'-dichloro-3,3'-bis(n.sulfopropyl)-9-ethyloxacarbo-cyanine hydroxide.

In classical emulsion preparation spectral sensitization traditionally follows the completion of chemical sensitization. However, in connection with tabular grains, it is specifically considered that spectral sensitization may occur simultaneously with or may even precede completely the chemical sensitization step: the chemical sensitization after spectral sensitization is believed to occur at one or more ordered discrete sites of tabular grains as has been described in e.g. U.S. Pat. Nos. 4,434,226 and 4,439,520. This may also be done with the emulsions of the present invention, wherein the chemical sensitization may further proceed in the presence of one or more phenidone and derivatives, a dihydroxy benzene e.g. hydroquinone, resorcinol, catechol and/or a derivative(s) therefrom, one or more stabilizer(s) or antifoggant(s), one or more spectral sensitizer(s) or combinations of said ingredients. Especially 1-p-carboxyphenyl, 4,4' dimethyl-3-pyrazolidine-1-one may be added as a preferred auxiliary agent.

As it has already been mentioned hereinbefore an increased dye stain of the fully processed radiographic elements can occur as dye stain is the result of an incomplete removement of the spectral sensitizer during processing because of the high surface to volume ratio tabular grains contain significantly higher amounts of spectral sensitizer per volume of silver halide to obtain the optimal sensitivity. It has now quite unexpectedly been found that by coating in at least one emulsion layer of the compounds for use according to this invention, like e.g. the compounds I.1 to I.3 given hereinbefore, the dye stain level is remarkably reduced.

The silver halide emulsion layer(s) in accordance with the present invention or the non-light-sensitive layers may further comprise compounds preventing the formation of fog or stabilizing the photographic characteristics during the production or storage of the photographic elements or during the photographic treatment thereof. Many known compounds can be added as fog-inhibiting agent or stabilizer to the silver halide emulsion layer or to other coating layers in water-permeable relationship therewith such as an undercoat or a protective layer. Suitable examples are e.g. the heterocyclic nitrogen-containing compounds such as benzothiazolium salts, nitro-imidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB 1,203,757, GB 1,209,146, JA-Appl. 75-39537, and GB 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide. Other compounds that can be used as fog-inhibiting compounds are metal salts such as e.g. mercury or cadmium salts and the compounds described in Research Disclosure No. 17643 (1978), Chapter VI. Many of these fog-inhibiting compounds may have been already added during the chemical ripening of the tabular silver halide crystals.

Polyethylene oxide compounds carrying thioether groups according to this invention can be combined with the antifoggants mentioned hereinbefore. Especially preferred antifoggants used in the light-sensitive layer(s) and/or in an adjacent non-light-sensitive layer or layers are the compounds (II.1) to (II.3) given hereinafter:

(II.1)

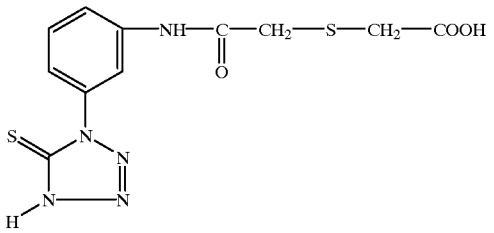

(II.2)

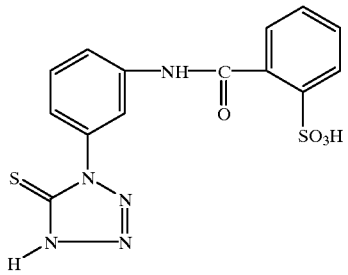

(II.3)

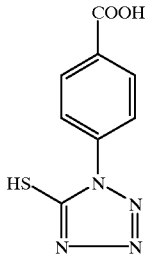

In the preparation of emulsions according to the present invention there is no need for the use of a special oxidized gelatin or the presence of a synthetic peptizer. Conventional lime-treated or acid treated gelatin can be used. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No. 16, page 30 (1966). Before and during the formation of the silver halide grains it is common practice to establish a gelatin concentration of from about 0.05% to 5.0% by weight in the dispersion medium. Additional gelatin is added in a later stage of the emulsion preparation, e.g. after washing, to establish optimal coating conditions and/or to establish the required thickness of the coated emulsion layer. Preferably a ratio by weight of gelatin to silver halide, the silver halide expressed as silver nitrate, ranging from 0.3 to 1.0 is then obtained.

The gelatin binder of the photographic elements can be forehardened with appropriate hardening agents such as those of the epoxide type, those of the ethylenimine type, those of the vinylsulfone type e.g. di-vinyl-sulphonyl-methane, ethylene di-(vinyl-sulphone), 1,3-vinylsulphonyl-2-propanol, bis-(vinylsulphonyl-methyl)-ether, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds as e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EU Patent Application 408,143.

The photographic material according to this invention may contain one or more of the polyethylene oxide compounds in at least one tabular silver bromide or bromoiodide emulsion crystal layer and/or in at least one non-light-sensitive protective layer. The said polyoxyethylene compound(s) may be added to the layer(s) in a solution or in a dispersed form. In the latter case a suitable solvent having no harmful effect on the emulsion and generally solvents which are miscible with water should be preferred as there are ethanol, acetone, pyridine, N,N-dimethylformamide, dimethyl sulphoxide, N-methyl-pyrrolidone etc.

When incorporated in the light-sensitive and/or in the non-light-sensitive layer(s) of a photographic material the compound(s) according to the present invention are added in amounts varying from 0.1 mg to 50 mg and more preferably from 0.1 to 20 mg per square meter and per side of the support coated with silver halide emulsion. Addition of the said compound(s) may be performed at any stage of the emulsion preparation but addition just before coating is preferred. In some cases it may be more preferable to add the compound(s) by dosage at the coating machine just before the layer(s) is(are) coated on the support.

Besides the use in radiographic materials the photographic tabular grains and the polyoxyethylene compounds in connection with the present invention can be used in various types of photographic elements, e.g. black and white silver halide photographic materials, like materials for graphic or micrographic applications, or colour sensitive materials.

The photographic element may contain one single emulsion layer, as it is the case for many applications, or it can be built up by two or even more emulsion layers. In X-ray photography a material with a single or a duplitized emulsion layer coated on one or both sides of the support may contain silver halide emulsions according to the invention. By using duplitized emulsions differing in photographic speed by at least 0.15 log E a gain in cross-over exposure in double side coated materials can be obtained. In the case of color photography the material contains blue, green and red sensitive layers each of which can be single coated, but normally consist of double or even triple layers. Besides the light sensitive emulsion layer(s) the photographic material may contain several light-insensitive layers, e.g. a protective layer, one or more backing layers, one or more subbing layers, one or more intermediate layers e.g. filter layers and even an afterlayer containing e.g. the hardening agent(s), the antistatic agent(s), filter dyes for safety-light purposes etc.

The photographic element of the present invention may further comprise various kinds of surface-active agents in the photographic emulsion layer or in at least one other hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration. Preferred surface-active coating agents are compounds containing perfluorinated alkyl groups.

The photographic element of the present invention nay further comprise various other additives such as e.g. compounds improving the dimensional stability of the photographic element, UV-absorbers, spacing agents and plasticizers.

Suitable additives for improving the dimensional stability of the photographic element are e.g. dispersions of a water-soluble or hardly soluble synthetic polymer e.g. polymers of alkyl(meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, Alpha-Beta-unsaturated dicarboxylic acids, hydroxyalkyl (meth) acrylates, sulphoalkyl (meth)acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. No. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455. UV-absorbers are especially useful in colour materials where they prevent the fading by light of the colour images formed after processing.

Spacing agents can be present of which, in general, the average particle size is comprised between 0.2 and 10 $\mu$m. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl. methacrylate, and of hydroxypropylmethyl cellulose hexahydrophthalate. Other suitable spacing agents have been described in U.S. Pat. No. 4,614,708.

The photographic material can contain several non-light sensitive layers, e.g. an antistress topcoat layer, one or more backing layers, and one or more intermediate layers eventually containing filter- or antihalation dyes that absorb scattering light and thus promote the image sharpness. Suitable light-absorbing dyes used in these intermediate layers are described in e.g. U.S. Pat. Nos. 4,092,168 and 4,311,787, DE 2,453,217, and GB Patent 7,907,440. Situated in such an intermediate layer between the emulsion layer(s) and the support there will be only a small negligable loss in sensitivity but in rapid processing conditions decolouration of the filter dyes may form an additional problem. A solution therefor can be found by decreasing the thickness of the whole coated layer packet.

One or more backing layers can be provided at the non-light sensitive side of the support of materials coated with at least one emulsion layer at only one side of the support. These layers which can serve as anti-curl layer can contain e.g. matting agents like silica particles, lubricants, antistatic agents, light absorbing dyes, opacifying agents, e.g. titanium oxide and the usual ingredients like hardeners and wetting agents.

The support of the photographic material may be opaque or transparent, e.g. a paper support or resin support. When a paper support is used preference is given to one coated at one or both sides with an Alpha-olefin polymer, e.g. a polyethylene layer which optionally contains an antihalation dye or pigment. It is also possible to use an organic resin support e.g. cellulose nitrate film, cellulose acetate film, poly(vinyl acetal) film, polystyrene film, poly (etethylene terephthalate) film, polyearbonate film, polyvinylchloride film or poly-Alpha-olefin films such as polyethylene or polypropylene film. The thickness of such organic resin film is preferably comprised between 0.07 and 0.35 mm. These organic resin supports are preferably coated with a subbing layer which can contain water insoluble particles such as silica or titaniumdioxide.

The photographic material containing tabular grains prepared according to the present invention can be image-wise exposed by any convenient radiation source used for its specific application.

Of course processing conditions and composition of processing solutions are dependent from the specific type of photographic material in which the tabular grains and the polyoxyethylene compounds with recurring thioether groups according to the present invention are applied. For example, in a preferred embodiment of materials for X-ray diagnostic purposes said materials may be adapted to rapid processing conditions. Preferably an automatically operating processing apparatus is used provided with a system for automatic regeneration of the processing solutions. The forehardened material may be processed using one-part package chemistry or three-part package chemistry, depending on the processing application determining the degree of hardening required in said processing cycle.

Applications within total processing times of 30 seconds and lower up to 90 seconds, known as common praxis, are possible, but according to this invention lower dye stain levels after processing in rapid processing cycles of less than 60 seconds dry to dry can be obtained, even with low regeneration amounts for developer and/or fixer of 300 ml per square meter and 500 ml per square meter of processed film respectively.

Processing a photographic material according to this invention may be performed in any suitable well-known developer and fixer used for the processing of the said photographic materials. A useful processing method suitable for X-ray photographic materials has e.g. been described in EP-Application No. 92.203.420.

Preferably, in accordance with this invention the development proceeds in a developer comprising 4-hydroxymethyl-4-methyl-1-phenyl-3-pyrazolidine-1-one as an auxiliary developing agent in addition to hydroquinone as main developing agent.

From an ecological point of view it is preferable to replace completely or part of the ammonium thiosulphate by sodium thiosulphate in the fixing solution. Preferable amounts of sodium thiosulphate are in the range of at least 200 g/l in a fixer ready-for-use.

An advantageous aspect related to this invention is the presence of the chemical compounds in the photographic material according to this invention. Opposite to the presence of the same compounds in the processing solutions, the amount required is much less, thus leading to a lower cost, if it is coated into the layer(s) of the silver halide photographic material comprising flat tabular grain emulsions with an average grain thickness of less than 0.30 $\mu$m. Moreover the products used have an activating effect resulting in an enhanced speed and contrast.

The following examples illustrate the invention without however limiting it thereto.

EXAMPLES

Example 1

A. Description of the Double-side Coated X-ray Materials 1, 2 and 3.

MATERIAL 1

Emulsion Preparation.

A tabular silver bromoiodide emulsion, containing 1 mole % of AgI and 99 mole % of AgBr, was precipitated using the double jet technique. The thus obtained tabular grain emulsion, containing 75 grams of gelatin pro mole of $AgNO_3$, had the following characteristics:

mean diameter of the circle with the same projective surface of the tabular grain: 1.12+/−0.23 $\mu$m (0.23 being the standard variation s).

mean thickness of the tabular grains: 0.23 $\mu$m.

mean aspect-ratio: 5.5.

percentage of total projective surface covered by the tabular grains: 98%.

Chemical Sensitization.

This emulsion was chemically sensitised in the presence of 660 mg/mole of $AgNO_3$ of dye 1 (anhydro-5,5'-dichloro-3,3'-bis(n.sulfobutyl)-9-ethyloxacarbocyanine hydroxide), and optimal amounts of chloro auric acid, sodium thiosulphate and potassium thiocyanate to attain a good relationship between fog and sensitivity.

Preparation of the Emulsion Coating Solution.

The following ingredients were added per mole of silver halide

| | |
|---|---|
| 4-hydroxy-6-methyl-1,3,3a,7-tetraazaindene: | 0.29 grams |
| sorbitol | 9.10 grams |
| polyethylacrylate (MW = 1000000) | 14.50 grams |
| 1,3dihydroxybenzene | 3.05 grams |
| dextrane (MW = 10000) | 31.00 grams |

Composition of the Protective Layer:

The coating weight is expressed in grams per square meter per side

| | |
|---|---|
| gelatin | 1.10 |
| polymethylmethacrylate (average particle diameter: 3.5 μm) | 0.023 |
| formaldehyde | 0.1 |

Coating:

Both emulsion layer and protective layer were simultaneously coated on both sides of a blue polyethylene terephthalate film support of 175 μm thickness. The resulting photographic material contained an amount of silver halide corresponding to 3.5 grams of $AgNO_3$ per $m^2$ per side.

MATERIAL 2

Same material as material 1 except for the presence of compound (I.1) that was added to the protective layer in an amount of 10 mg per square meter per side.

MATERIAL 3

Same material as material 1 except for the presence of compound (I.2) that was added to the protective layer in an amount of 10 mg per square meter per side.

MATERIAL 4

Same material as material 1 except for the presence of compound (1.3) that was added to the protective layer in an amount of 10 mg per square meter per side.

B. Exposure, Sensitometry and Densitometry:

Samples of the photographic materials 1 to 4 were exposed using a continuous wedge with green light of 540 nm during 0.02 seconds and were processed under the circumstances described further. The density as a function of the light dose was measured and therefrom were determined: fog level (with an accuracy of 0.001 density point), the relative speed S at a density of 1 above fog (material 1 was set to a speed of 100), maximum density DMAX and the gradient AG measured between the densities 0.25 above fog and 2.0 above fog.

C. Processing Conditions:

Conditions for the 38 Seconds Processing Cycle.

processing machine: CURIX HT530 (Agfa-Gevaert trademarked name) with the following time (in seconds) and temperature (in ° C.) characteristics:

| | | |
|---|---|---|
| loading: | 0.2 sec. | |
| developing: | 9.3 sec. | 37° C. |
| cross-over: | 1.4 sec. | |
| rinsing: | 0.9 sec. | |
| cross-over: | 1.5 sec. | |
| fixing: | 6.6 sec. | 35° C. |
| cross-over: | 2.0 sec. | |
| rinsing: | 4.4 sec. | 20° C. |
| cross-over: | 4.6 sec. | |
| drying: | 6.7 sec. | |
| total | 37.6 sec. | |

Composition of the Developer Ready-for-use:

| | |
|---|---|
| sodium bromide | 2.2 grams |
| potassium sulphite | 83.0 grams |
| ethylenediaminetetraacetic acid, sodium salt, trihydrate | 4.0 grams |
| hydroquinone | 34.0 grams |
| 5-methylbenzotriazole | 0.12 grams |
| sodium carbonate | 9.2 grams |
| potassium hydroxide | 13.4 grams |
| diethylene glycol | 12.0 ml |
| 4-hydroxymethyl-4methyl-1phenyl-3-pyrazolidine-1-one | 5.9 grams |
| sodium sulphate | 3.2 grams |

Water to make 1 liter pH adjusted to 10.70 at 25° C. with potassium hydroxide.

Composition of Fixer Ready-for-use:

The fixer ready for use contained pro liter:

| | |
|---|---|
| sodium thiosulfate (78% solution) | 314 grams |
| sodium sulphite | 20 grams |
| borax | 18 grams |
| citric acid | 20 grams |
| sodium hydroxide | 2.0 grams |
| water to make 1 liter | |
| pH adjusted to 5.30 at 25° C. | |

D. Determination of Dye Stain After Processing

Unexposed samples of materials 1 to 4 were processed under the above descrided processing conditions. Using a GRETAG SPM 100 spectrophotometer (light source C2, no polarizer) the Lab values (CIELAB Colorimeteric method) of these samples where measured on a white sheet of paper. The dye stain is then measured as a highly positive "a"-value, indicating a more red coloration.

E. Results.

Table 1 gives fog, speed, average gradient and the Lab values after processing materials Nos. 1 to 4 in the above described 38 seconds processing cycle. The Lab values of the uncoated support are given as a reference.

TABLE 1

| Material | Comp. | Fog Dens. | Speed | Average Gradient | L | a | b |
|---|---|---|---|---|---|---|---|
| Support | ref. | — | — | — | 69.6 | −5.4 | −26.7 |
| 1 | comp. | 0.015 | 100 | 2.79 | 69.6 | 1.98 | −22.1 |
| 2 | (I.1) | 0.045 | 163 | 3.30 | 70.2 | −0.55 | −21.2 |
| 3 | (I.2) | 0.020 | 123 | 2.99 | 69.8 | 0.77 | −21.6 |
| 4 | (I.3) | 0.022 | 120 | 2.81 | 70.0 | 0.80 | −21.5 |

Table 1 shows the activating effect of compounds (I.1), (I.2) and (I.3) resulting in a higher speed, fog and clearly higher average gradient. Unexpectedly the a-values of materials Nos. 2, 3 and 4 are lower than the a-value of the reference material. This means that materials Nos. 2, 3 and 4 show less dye stain than material No 1.

What is claimed is:

1. Photographic material comprising a support having on at least one side thereof at least one light-sensitive silver halide layer and at least one non-light-sensitive layer containing in at least one light-sensitive layer spectrally sensitized silver bromide or silver bromoiodide tabular grains having an average thickness of less than 0.30 μm and which is characterised in that the said photographic material further contains in at least one non-light-sensitive layer at least one polyoxyethylene compound comprising from about 20 to 100 mole percent recurring units of the formula (Ia)

(Ia)

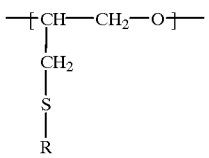

and 80 to 0 mole % recurring units of the formula (Ib)

(Ib)

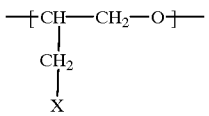

and wherein R represents an aliphatic, aromatic, or heterocyclic group, and X represents a halogen.

2. Photographic material according to claim 1 wherein the at least one polyoxyethylene compound comprises from about 60 to 100 mole percent recurring units of the formula (Ia) and 40 to 0 mole % recurring units of the formula (Ib).

3. Photographic material according to claim 1 wherein R is a member selected from the group consisting of alkyl, aralkyl, hydroxyalkyl, alkoxyalkyl, alkylthioalkyl, acyloxyalkyl, cycloalkyl and aryl.

4. Photographic material according to claim 3 wherein R is a $C_1$ to $C_5$ alkyl group.

5. Photographic material according to claim 1 wherein the silver bromide and silver bropoiodide grains are spectrally sensitized with anhydro-5,5'-dichloro-3,3'-bis(n.sulfobutyl)-9-ethyloxacarbo-cyanine hydroxide or anhydro-5,5'-dichloro-3,3'-bis(n.sulfopropyl)-9-ethyloxacarbo-cyanine hydroxide.

6. Photographic material according to claim 1 wherein the said material is an X-ray photographic material containing silver halide at one or both sides of the support.

7. Photographic material according to claim 6 wherein the said polyoxyethylene compound is present in an amount of 0.1 to 20 mg per square meter and per side of the support.

* * * * *